US006145523A

United States Patent [19]

Lo

[11] Patent Number: 6,145,523

[45] Date of Patent: Nov. 14, 2000

[54] SPREAD POSITION SECURING DEVICE FOR BEACH PARASOLS

[76] Inventor: Albert Chong-Jen Lo, 3023 Windy Knoll Ct., Rockville, Md. 20850

[21] Appl. No.: 09/159,395

[22] Filed: Sep. 23, 1998

[51] Int. Cl.[7] ..... A45B 25/06

[52] U.S. Cl. ..... 135/28; 135/39; 135/41

[58] Field of Search ..... 135/15.1, 20.3, 135/28, 37, 38, 39, 41

[56] References Cited

U.S. PATENT DOCUMENTS

| | | | |
|---|---|---|---|
| 3,643,674 | 2/1972 | Granrath | 135/25 |
| 4,038,997 | 8/1977 | Smith | 135/15.1 |
| 5,046,518 | 9/1991 | Chang | 135/37 |
| 5,050,627 | 9/1991 | Hengtzu | 135/23 |
| 5,224,505 | 7/1993 | Wu | 135/24 |
| 5,232,004 | 8/1993 | Wu | 135/24 |
| 5,253,666 | 10/1993 | Huang | 135/28 |
| 5,826,604 | 10/1998 | Hartmann | 135/27 |

*Primary Examiner*—Beth A. Aubrey
*Attorney, Agent, or Firm*—Pro-Techtor International Services

[57] ABSTRACT

A spread position securing device for beach parasols includes a shank, a fixing base on an upper portion of the shank, and a runner fitted around slidably along the shank, plural ribs pivotally connected radially to the fixing base, and plural stretchers connected pivotally between the runner and intermediate portions of the ribs. Then the parasol can be spread from a collapsed position to a spread position. The feature of the invention is a cylindrical sleeve fixed in the runner and fitted around the shank to slide up and down so that the cylindrical sleeve may contact the fixing base to secure the contact points of the stretchers with the runners at a little higher position than the contact points of the stretchers with the ribs when the runner is pushed up to the spread position. Thus no other components are needed to secure the spread position of the parasol, convenient to handle.

1 Claim, 7 Drawing Sheets

SPREAD POSITION SECURING DEVICE FOR BEACH PARASOLS

BACKGROUND OF THE INVENTION

This invention relates to a spread position securing device for beach parasols, particularly to one needing no special components for securing a spread position for beach parasols, very convenient for spreading and collapsing.

Beach parasols are widely used for shading sunlight and preventing rain in leisure activities, including a shaft, a plurality of ribs and stretchers for spreading and collapsing, and a canopy laid on the ribs. In using it, the ribs are pushed up from a collapsed position and spread and stopped by some means provided in an upper portion of the shaft for securing the spread position. In order to secure the spread position of the ribs relative to the shank, a stop component should be provided at an upper portion of the shank, such as an elastic means capable to move in and out of the shank after inner ends of all ribs are pivotally connected to a runner, which is then pushed up and stopped by the elastic means. Or some parasols are provided with an engaging means eccentrically fixed with the runner, and pulled down to engage the shank to secure the spread position when the runner is pushed up to the spread position. These kinds of spread position securing devices for beach parasols are very often seen.

The traditional spread position securing devices described above have to have an specially added components such as an elastic means or an engaging means, resulting in extra cost for them, and further they make a kind of inconvenience in securing the spread position. Further, the elastic means may involve accidental harm to a finger in pushing down and releasing it in case of collapsing, which is often experienced by users.

SUMMARY OF THE INVENTION

This invention has been devised to offer a spread position securing device for beach parasols, capable to secure a spread position of a beach parasol without using an additional component such as the elastic means or the engaging means used in the traditional spread position securing devices for beach parasols described above.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
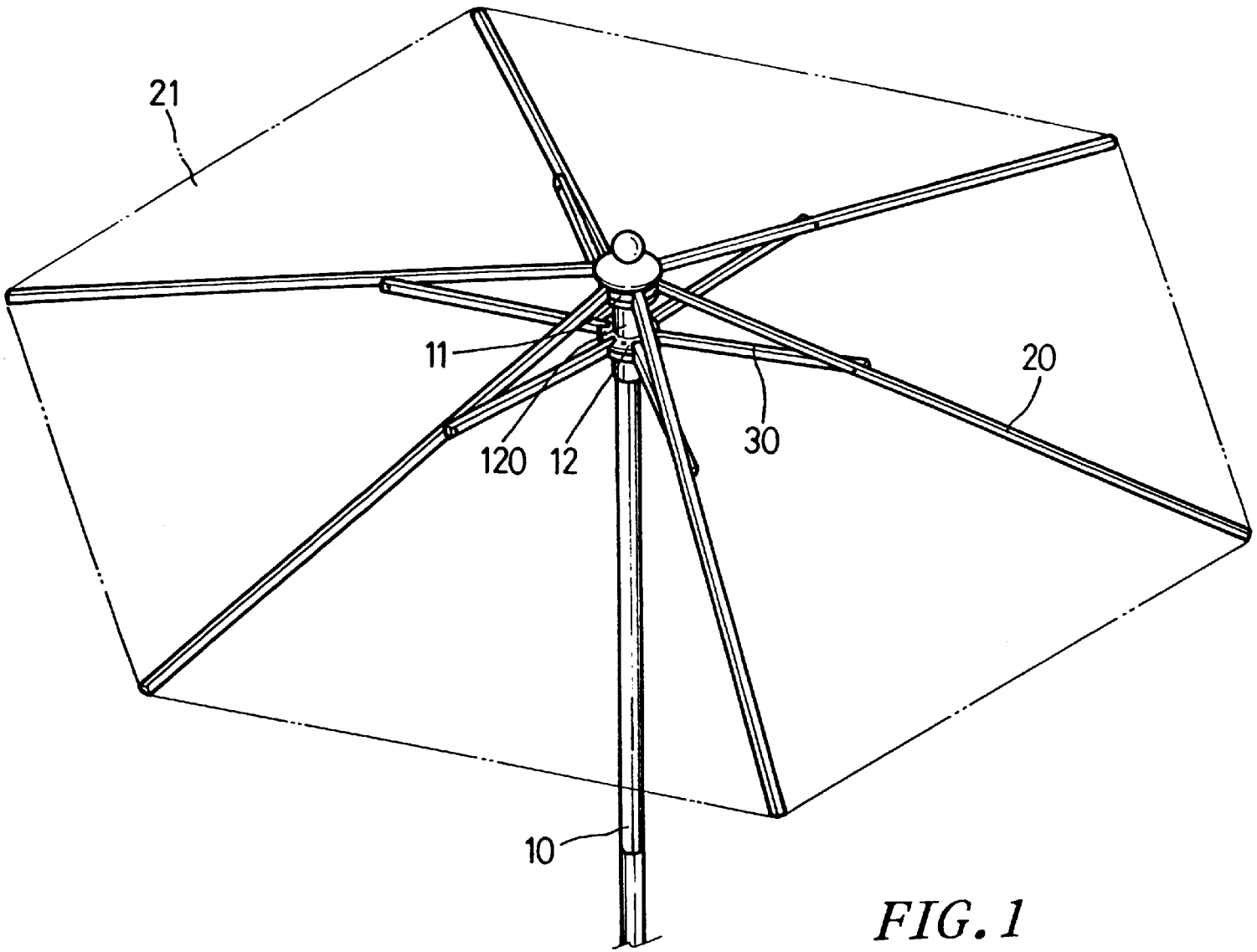
FIG. 1 is a perspective view of a beach parasol provided with a spread position securing device in the present invention.
Figure 4:
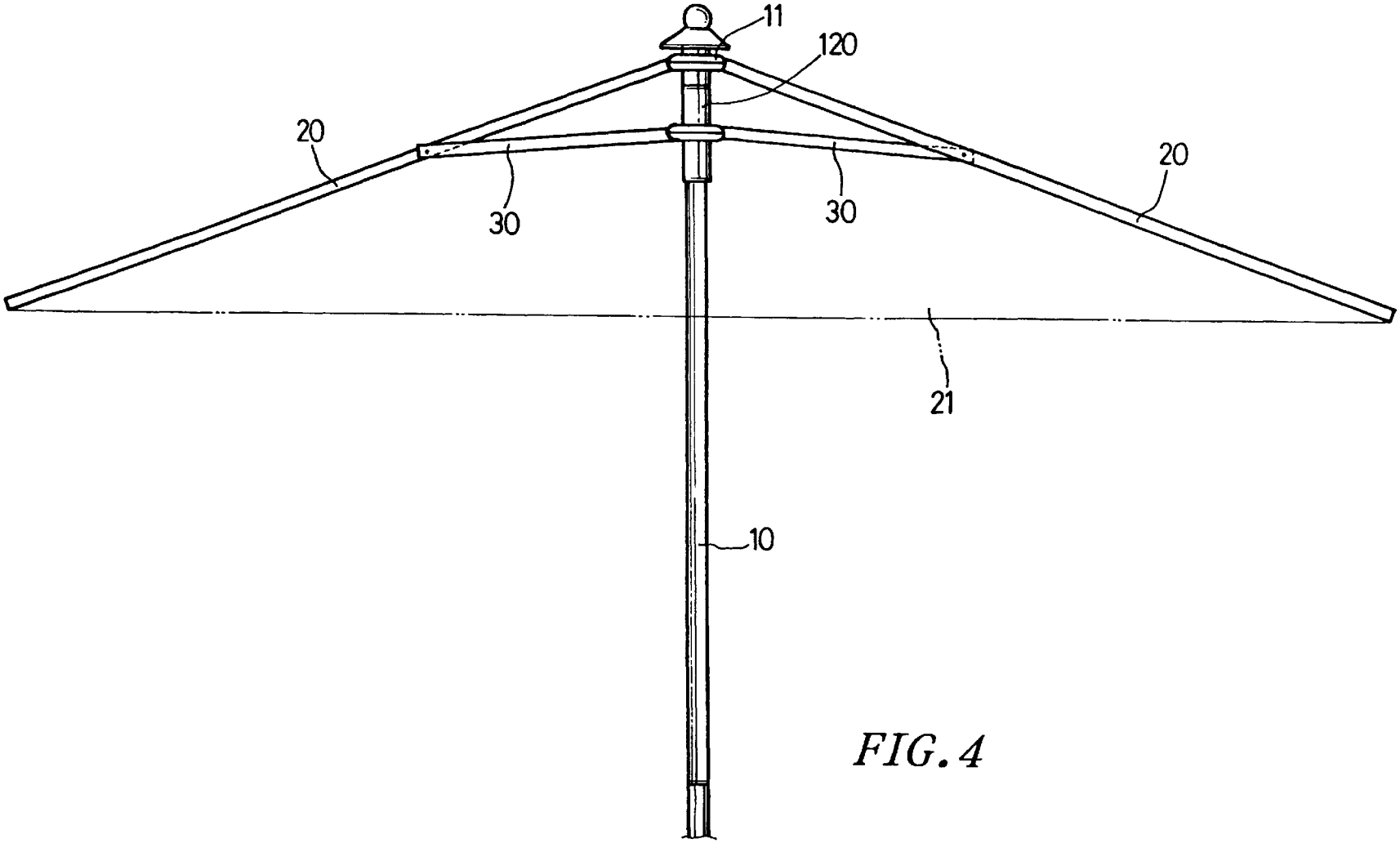
FIG. 4 is a side view of the beach parasol provided with the spread position securing device in the present invention, showing it being in a spread position.

A preferred embodiment of a spread position securing device for beach parasols in the present invention, as shown in FIGS. 1 and 4, includes a shank 10, a circular fixing base 11, a runner 12, a plurality of ribs 20, the same number of stretchers 30 as the ribs 20.

Figure 2:
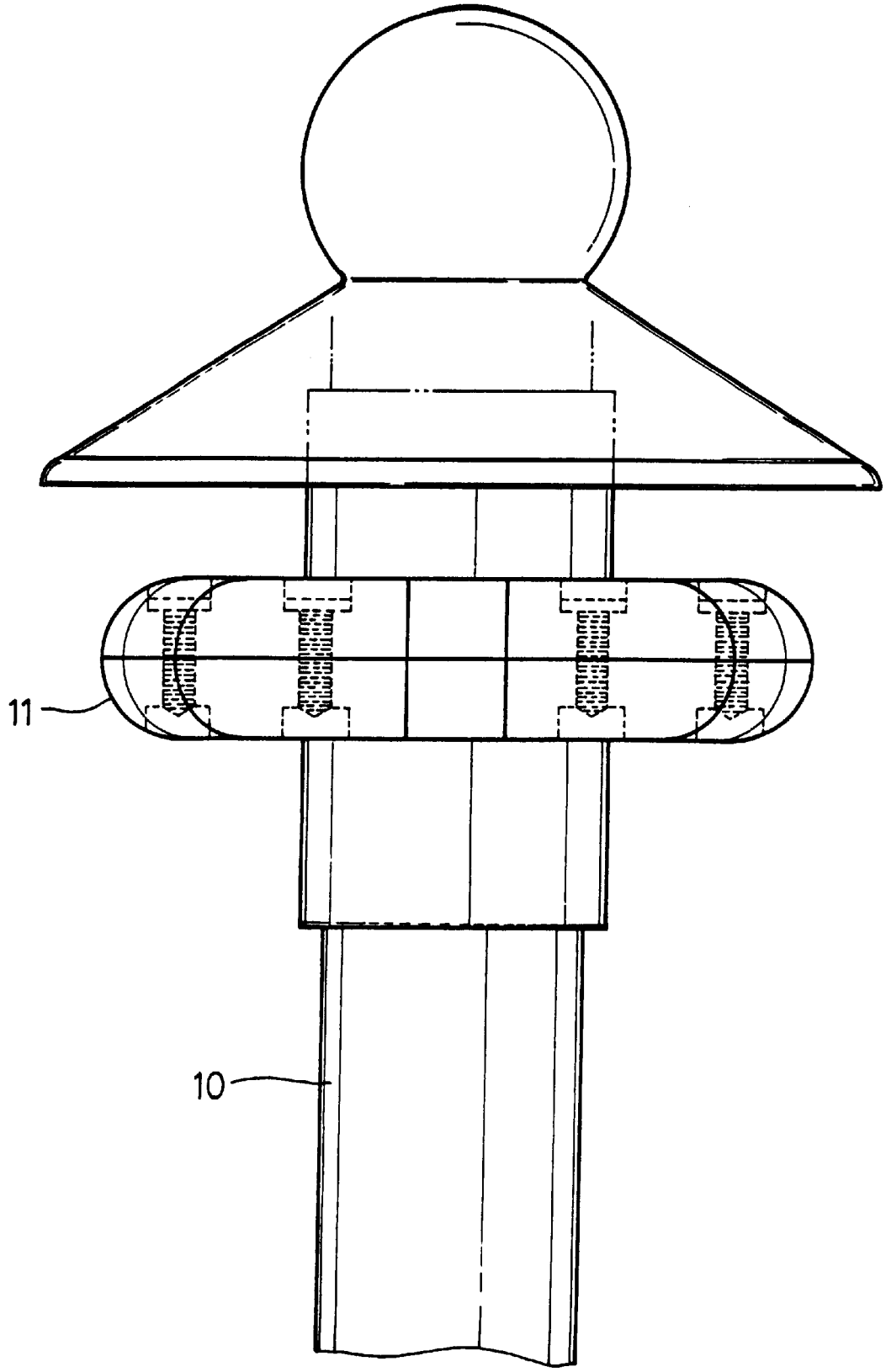
FIG. 2 is a side view of a fixing cap in the spread position securing device for beach parasols in the present invention.

The shank 10 has its upper portion fixed with the circular fixing cap 11, as shown in FIG. 2.

The circular fixing base 11 is fixed firmly on the upper portion of the shank 10.

Figure 3:
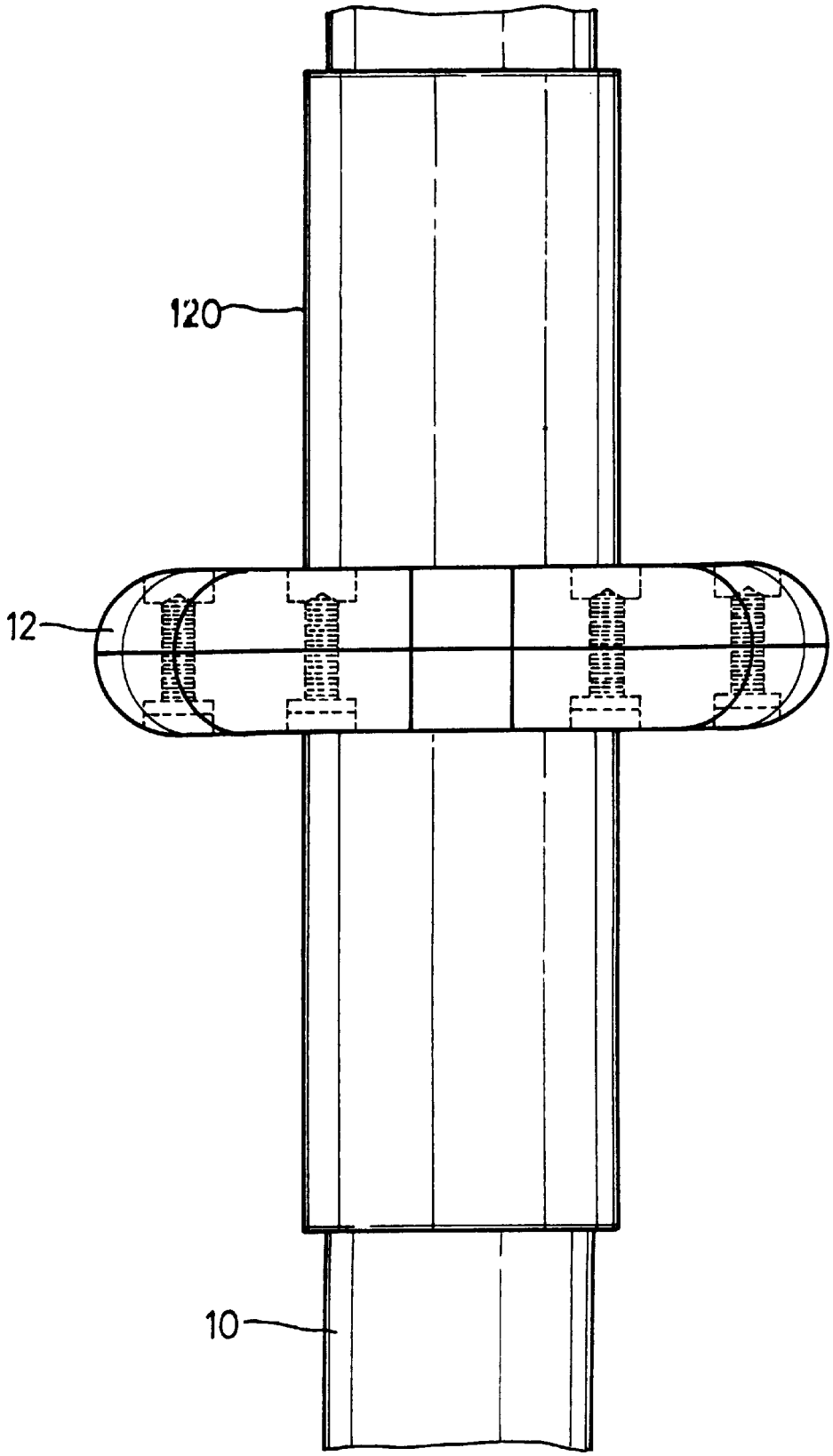
FIG. 3 is a side view of a runner in the spread position securing device for beach parasols in the present invention.

The runner 12 is fitted slidably up and down around the shank 10, as shown in FIG. 3.

The ribs 20 have upper ends pivotally connected to the circular fixing base 11 in a radial condition, inner ends pivotally connected to the fixing base 11, with a canopy 21 laid on the ribs 20, as shown with dotted lines in FIG. 1.

The stretchers 30 have outer ends pivotally connected to intermediate portions of the ribs 20, and inner ends pivotally connected to the runner 12 in a radial position so that when the runner 12 is moved to slide up along the shank 10 all the stretchers 30 and the ribs 20 are swung upward and outward. (FIG. 1 shows they are spread up and out.) On the contrary, the runner 12 can be pushed to slide down along the shank 10 from the spread position shown in FIG. 1 to the collapsed position shown in FIGS. 6 and 7, with the ribs 20 together with the canopy 21 and the stretchers 30 swinging down at the same time.

Figure 5:
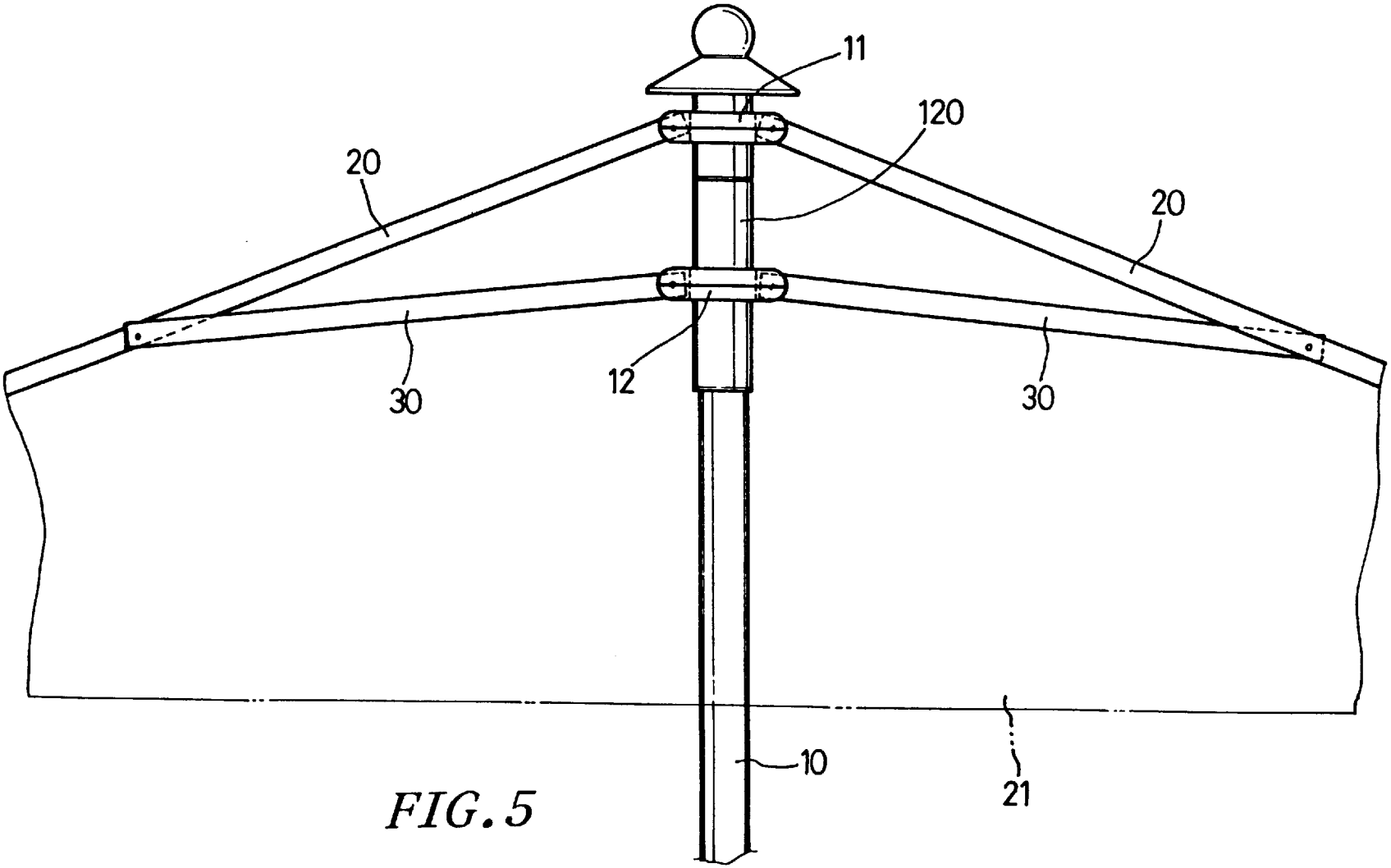
FIG. 5 is another side view of the beach parasol provided with the spread position securing device in the present invention, showing it being in the spread position.

A main improvement of the invention is that when the parasol is in the spread position, the connect points of the stretchers 30 with the runner 12 is a little higher than the connect points of the outer ends of the stretchers 30 with the ribs 20. Further, a cylindrical sleeve 120, which is fixed with an inner side of the runner 12 and fitted around the shank 10, contacts with the fixing base 11, as shown in FIG. 5. Therefore, if the parasol is needed to be spread open, it is enough to push the runner 12 up until the cylindrical sleeve 120 contacts the fixing base 11. Then the stretchers 30 extend up and out the ribs 20 with the canopy 21 into the spread position, without any other components needed to stop the runner 12, very easy to handle.

Figure 6:
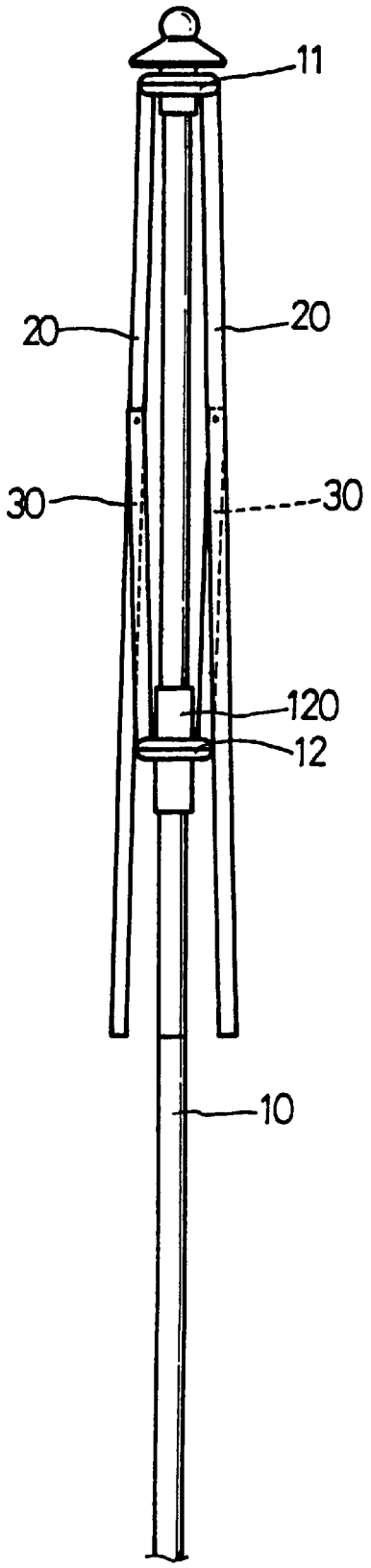
FIG. 6 is a side view of the beach parasol provided with the spread position securing device in the present invention, showing it being in a collapsed position; and, FIG. 7 is another side view of the beach parasol provided with the spread position securing device in the present invention, showing it being in the collapsed position.
Figure 7:
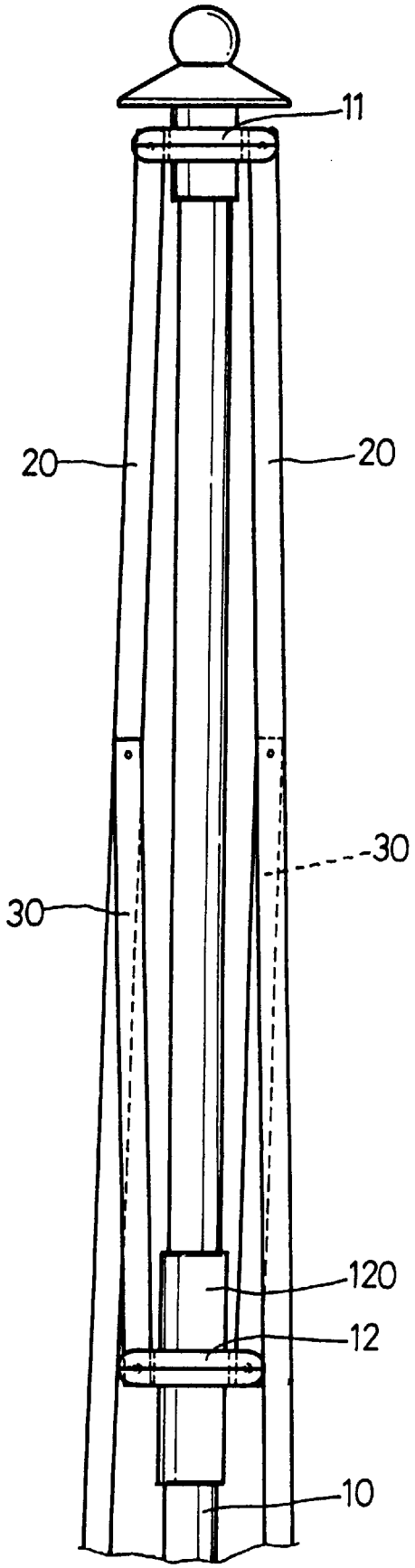

In case the parasol is to be collapsed from the spread position shown in FIG. 1, the runner 12 is only needed to be pushed to slide down along the shank 10, with the ribs 20 with the canopy 21 and the stretchers 20 also swung down to the collapsed position shown in FIGS. 6 and 7.

While the preferred embodiment of the invention has been described above, it will be recognized and understood that various modifications may be made therein and the appended claims are intended to cover all such modifications which may fall within the spirit and scope of the invention.

What is claimed is:

1. A spread position securing device for beach parasols comprising:

a shank, a fixing base fixed on an upper portion of said shank, a runner fitted around said shank below said fixing base, said runner slides up and down along said shank, a plurality of ribs having inner ends pivotally connected to said fixing base such that said ribs swing upward and downward with said fixing base as a pivot, a canopy laid on said ribs, a plurality of stretchers having inner ends pivotally connected to said runner and outer ends pivotally connected to intermediate portions of said ribs, each of said stretchers corresponds to one of said ribs, said stretchers spread up and out when said runner slides up along said shank, said stretchers collapse in and down when said runner slides down along said shank; wherein connection points of said stretchers with said runner are higher than connection points of said stretchers with said ribs when said parasol is expanded to a spread position, a cylindrical sleeve is provided in an inner side of said runner and fitted around said shank to slide up and down together with said runner along said shank, said cylindrical sleeve having an upper end contacting said fixing base when said parasol is in the spread position.

* * * * *